US006361368B1

(12) United States Patent
Tseng

(10) Patent No.: US 6,361,368 B1
(45) Date of Patent: Mar. 26, 2002

(54) CHRISTMAS BULB SOCKET

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/784,168

(22) Filed: Feb. 16, 2001

(51) Int. Cl.[7] ..... H01K 1/00; H01R 13/627; H01R 33/00

(52) U.S. Cl. ..... 439/619; 439/356; 362/226

(58) Field of Search ..... 439/619, 699.2, 439/356; 362/226, 249

(56) References Cited

U.S. PATENT DOCUMENTS 6,048,074 A * 4/2000 Wang ..... 362/226
6,113,430 A * 9/2000 Wu ..... 439/619

* cited by examiner

*Primary Examiner*—Brian Sircus
*Assistant Examiner*—Chandrika Prasad
(74) *Attorney, Agent, or Firm*—Fei-Fei Chao; Venable, Baetjer, Howard & Civiletti, LLP

(57) ABSTRACT

A Christmas bulb socket has a bulb seat and a bulb holder with a corresponding bulb. The socket is made from a resilient material and the bulb holder is designed to accommodate similar types of bulbs whereby two filament feet of the bulb are tightly retained in the seat and holder by a notch defined in a bottom face of the bulb holder.

3 Claims, 10 Drawing Sheets

CHRISTMAS BULB SOCKET

BACKGROUND OF THE INVENTION

1. Field of the Invention

The present invention relates to a Christmas bulb socket, especially a Christmas bulb socket that retains electrode feet of a bulb tightly.

2. Description of Related Art

Nowadays many families decorate their houses with Christmas bulbs at Christmas holidays to increase the joyful atmosphere. They hang strings or nets with many twinkling and tiny Christmas bulbs on the walls and the roof.

A conventional combining device for Christmas bulb as shown in FIG. 8 contains a bulb seat (70) and a bulb holder (80), and a bulb (90) is connected with two wires (72) by the seat (70) and the holder (80). The seat (70) is tubular and has an opening at the upper end and an aperture at a bottom face thereof. A stub (71) is formed on the outside wall of the seat to fix the holder (80). The two wires (72) are inserted inside the seat (70) via the aperture and each has a conductive plate (73) at a distal end.

The holder (80) is divided into an upper cylinder having a circular frame at the top of the upper portion and a lower insert having two through holes (83) which communicate with the upper cylinder. A clasp (82) protruding from an outside periphery of the holder (80) has a cutout (822) defined in the body thereof to mate with the stub (71) of the seat (70).

With reference to FIGS. 9 and 10, the bulb (90) is inserted in the holder (80) with two feet (91) of the bulb (90) respectively penetrating the through holes (83), and an exposed section of the feet (91) is bent outwardly along two opposite sides of the insert (81). Then the holder (80) with the bulb (90) is fitted into the seat (70), and the conductive plates (73) of the wires (72) electrically and conductively touch the feet (91), and finally the clasp (82) is bent downwardly to clip the stub (71) of the seat (70).

However, as the strings of such bulbs are often moved by wind etc and the bulbs brush against surfaces, it is found that the feet (91) of the bulb (90) are easy to be loosened when the bulb (90) is rocked, because the holder (80) has no positioning device to retain the feet (91) securely.

To overcome the shortcomings, the present invention tends to provide a Christmas bulb socket to mitigate and obviate the aforementioned problem.

SUMMARY OF THE INVENTION

The main objective of the invention is to provide a Christmas bulb socket that retains the filament feet of the bulb tightly to avoid the failure of the bulb caused from the loosening of the bulb feet.

Another objective of the invention is to keep each conductive plates of the wire in good contact with each corresponding filament foot to avoid mis-connection between the feet.

More apparent features and advantages are shown from the following detailed description when taken in conjunction with the accompanying drawings.

DETAILED DESCRIPTION OF PREFERRED EMBODIMENT

Figure 1:
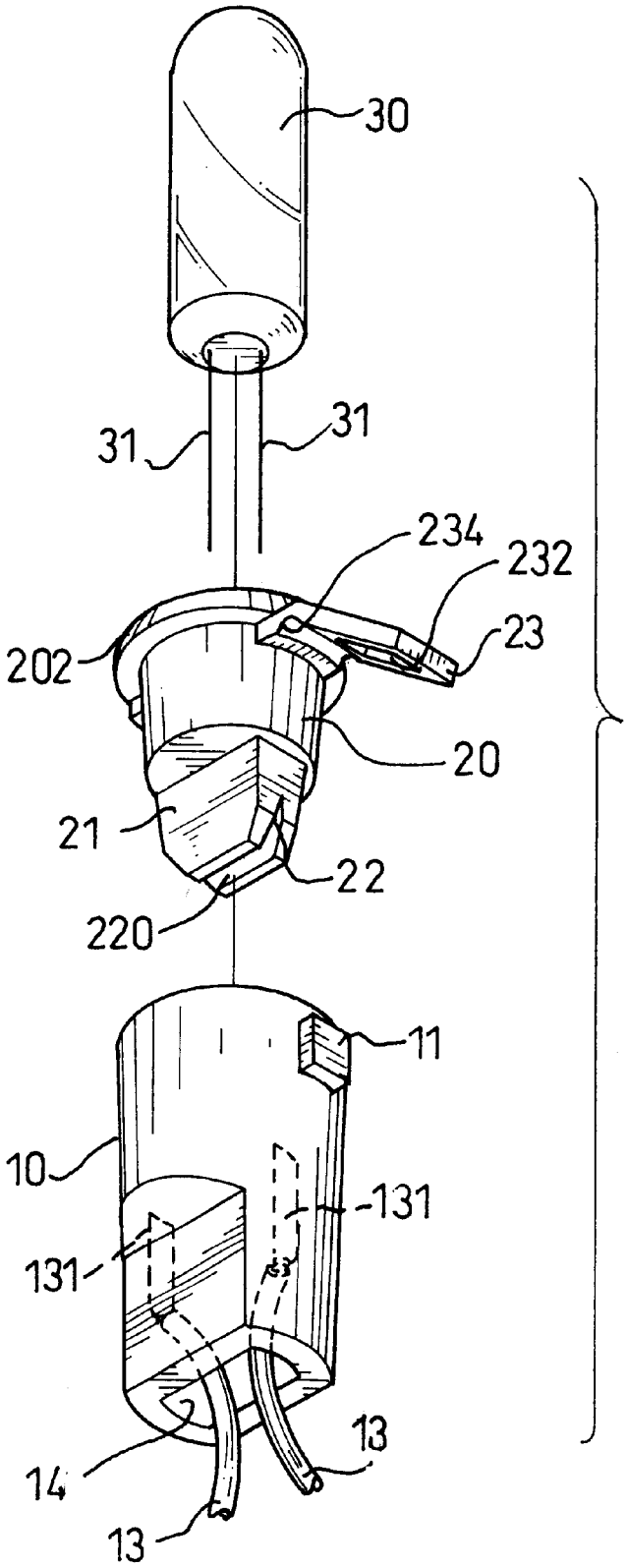
FIG. 1 is an exploded perspective view of a Christmas bulb socket.

With reference to FIG. 1, the Christmas bulb socket includes a bulb seat (10) and a bulb holder (20) to receive a bulb (30), wherein both the bulb seat (10) and the bulb holder (20) are made of resilient plastic.

The bulb holder (20) has a conical hollow body, a rim (202) formed at a top of the body, and a wedge (21) with two long sides and two short sides formed at a bottom of the body. The body defines a blind hole with an entrance at the rim (202) and a closed inner face substantially aligning with a junction of the body and the wedge (21). The blind hole has a diameter slightly smaller than a diameter of the bulb (30). A lateral notch (22) shaped as an inverted 'V' is defined in a bottom surface of the wedge (21). Two wire holes (220) extend between the inner face of the body and the notch (22). The short sides of the wedge (21) each have a sharply-inclined bottom section and a slightly inclined bottom section. Two upright side notches are respectively defined in the bottom sections of the short sides of the wedge (21) and extend into the notch (22). A lateral clasp (23) integrally extends from the body at a point directly below the rim (202), and a cutout (232) is defined in the clasp (23). A groove (234) is defined in an underface of the clasp (23) and near the body whereby the clasp (23) can be easily pivoted downward in respect to the body.

The bulb seat (10) has a cup-shaped upper portion and a flat bottom portion. The upper portion defines a conical cavity configured to snugly receive the body of the bulb holder (20) such that the rim (202) remains proud of a top edge of the upper portion. A passage (14) is defined from a bottom edge of the bottom portion to a bottom of the cavity. The passage (14) has a tapered upper part configured to compressibly receive the wedge (21) of the holder (20), and a plain lower part. A stub (11) is formed on an outer periphery of the upper portion of the bulb seat (10) and is sized to snappingly engage in the cutout (232) of the clasp (23).

The bulb (30) has two filament feet (31) extending from a bottom thereof.

Two electric wires (13) each have a conductive plate (131) secured at a distal end hereof.

Figure 3:
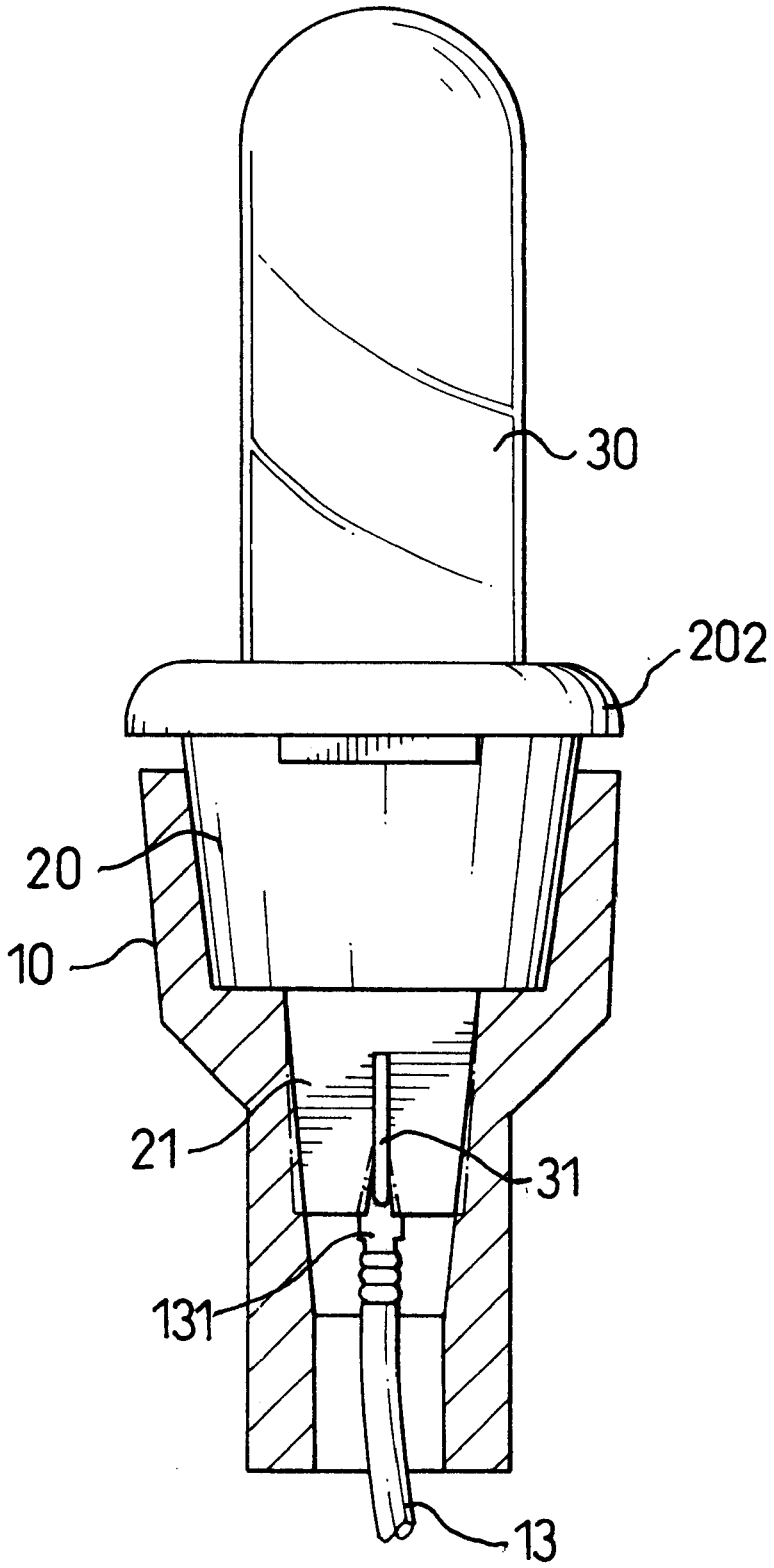
FIG. 3 is a cross-sectional side view of this invention when all elements are assembled.

In assembly, referring to FIG. 3, the wires (13) are fed into the upper part of the passage (14) via the lower part, and are rested on the respective side face. The bulb (30) is fitted in the blind hole of the bulb holder (20) and the filament feet

(31) are fed respectively through the wire holes (220) and into the notch (22), where after they are bent laterally in opposite directions and bent again upward into the respective side notch. The combined bulb (30) and bulb-holder (20) is then fitted into the bulb seat (10) by the wedge (21) and the body being respectively mated with the passage (14) and the cavity, whereby tips of the filament feet (31) are in contact with the respective plate (131) of the wires (13).

Figure 2:
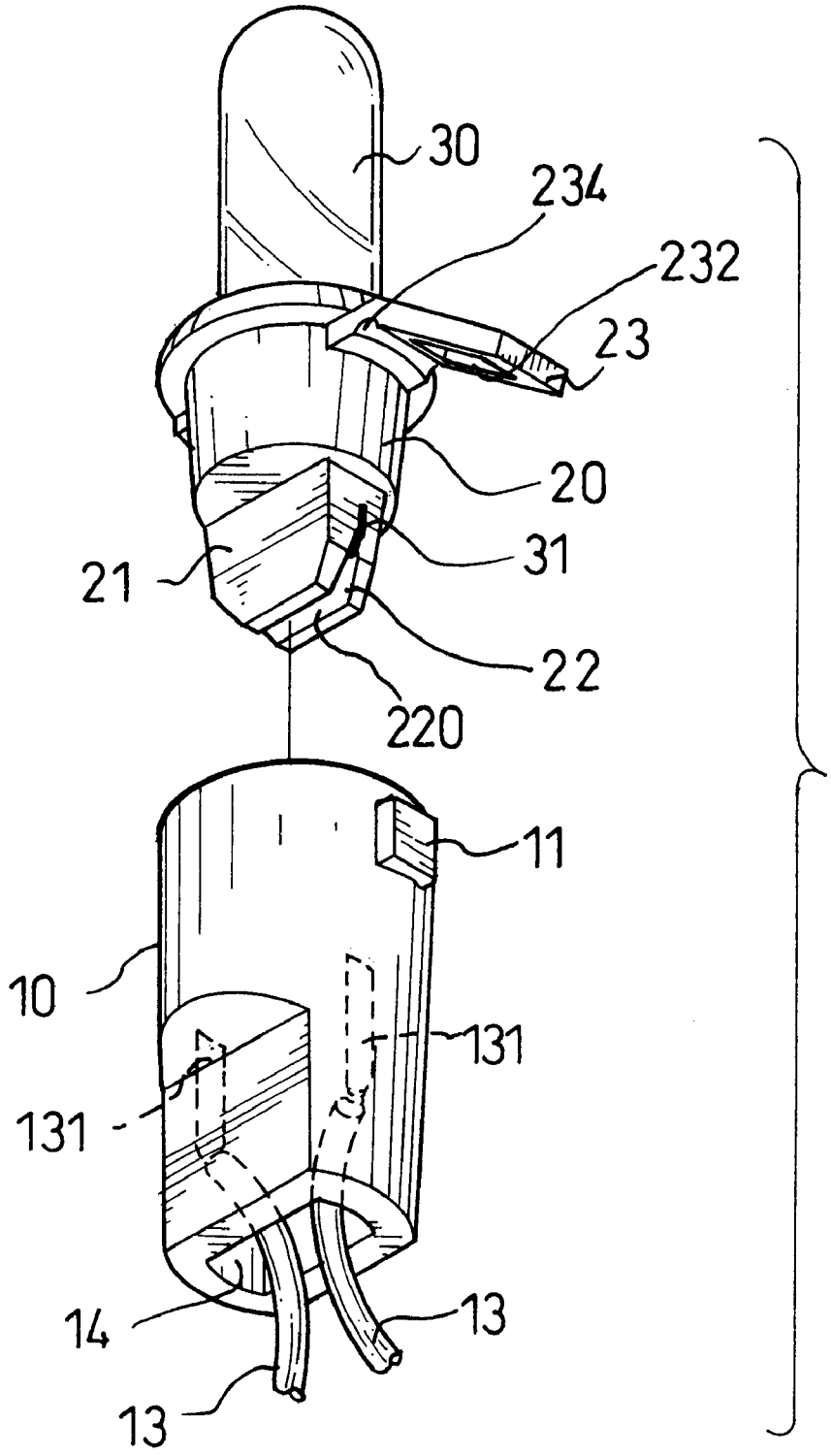
FIG. 2 is a perspective view of this partly assembled invention in accordance with FIG. 1.
Figure 4:
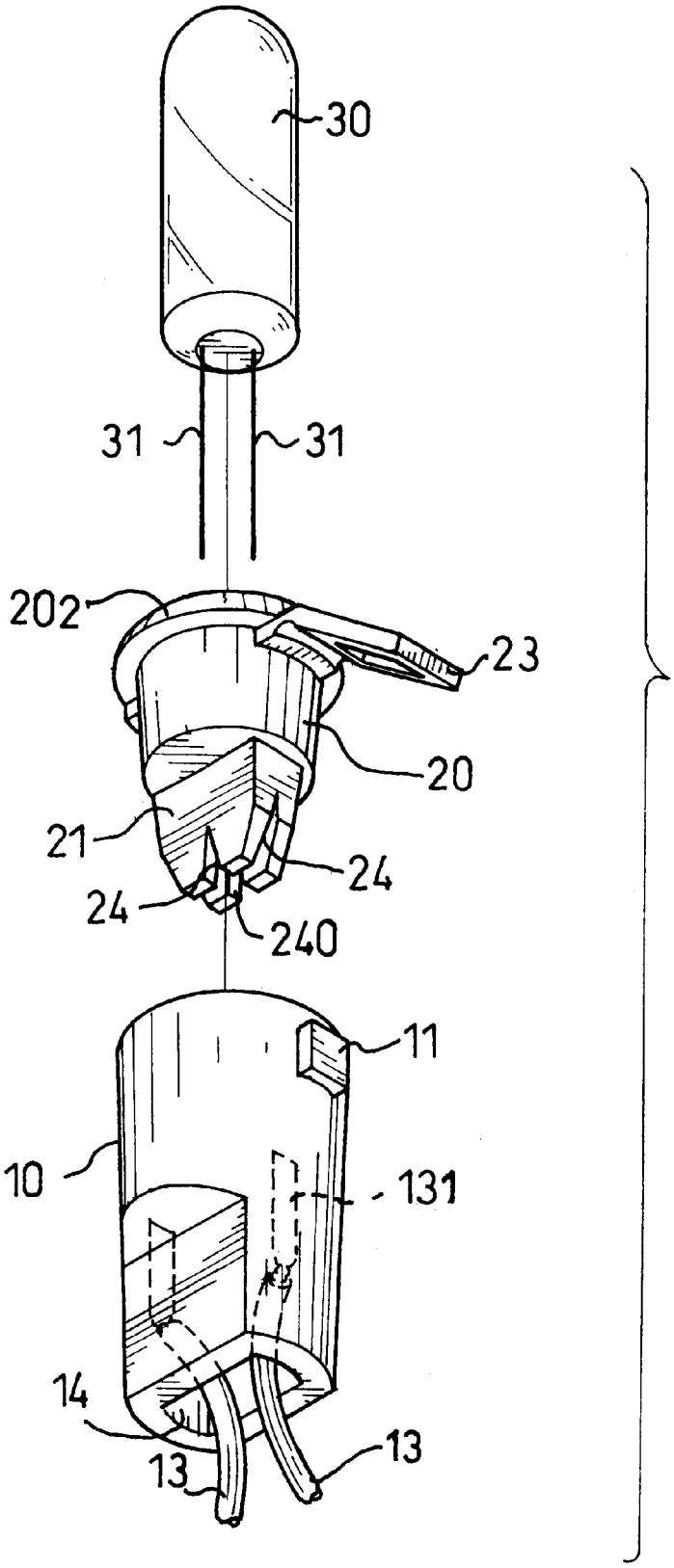
FIG. 4 is another preferred embodiment in relationship with this invention.
Figure 5:
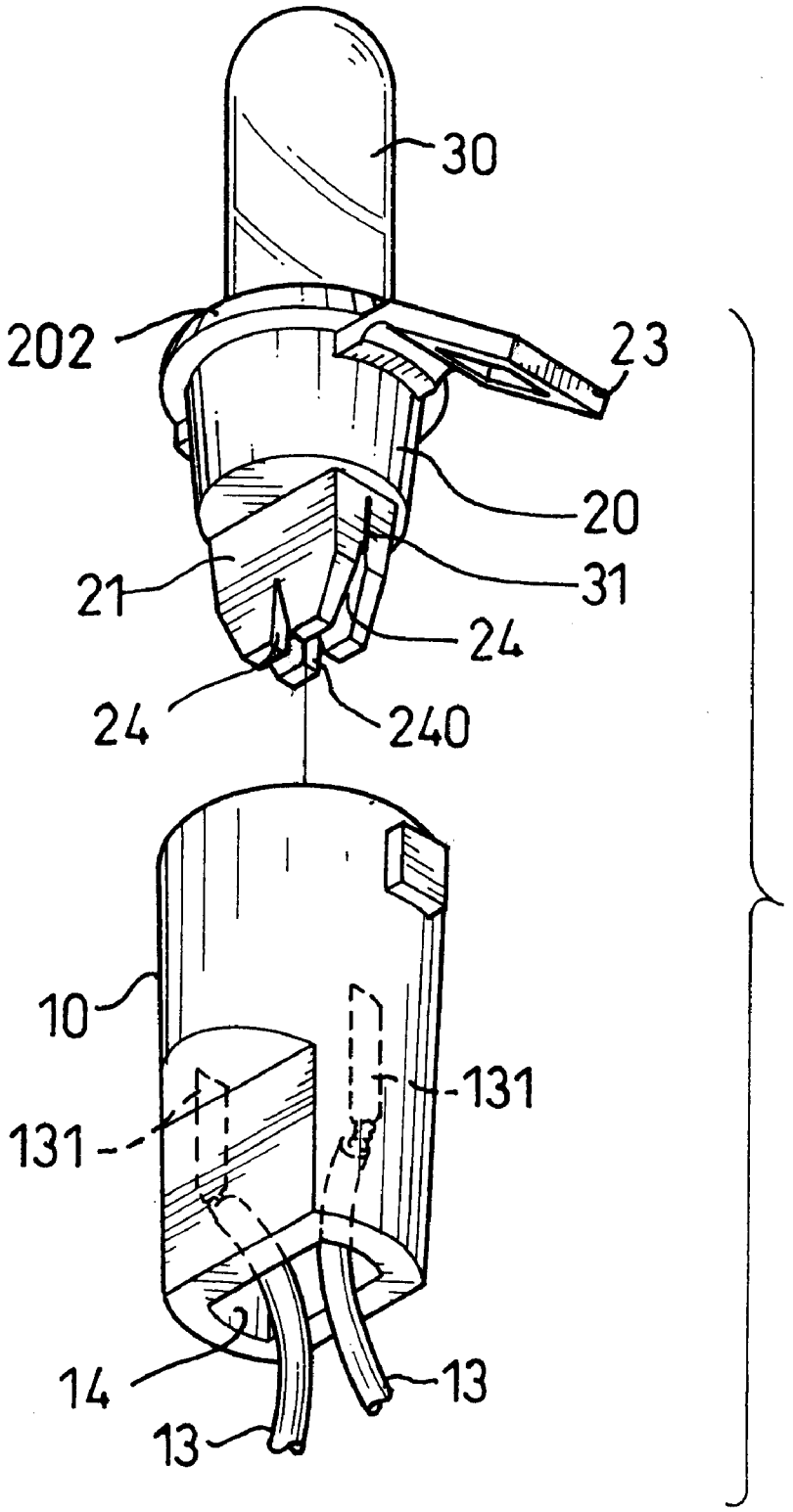
FIG. 5 is a perspective view of the partly assembled embodiment in accordance with FIG. 4.

Another preferred embodiment shown in FIGS. 4 and 5 is similar to the aforementioned invention in FIGS. 1, 2 and 3, wherein the bulb seat (10) and the bulb holder (20) are mostly the same with the previous one. The character is that the notch (24) is cross-shaped and has two wire holes (240) defined at the tapered end of the notch (24). The cross-shaped notch (24) makes the part of the wedge (21) easier to be resiliently deformed and has two axes of closure to retain the filament feet (31) firmly.

Figure 6:
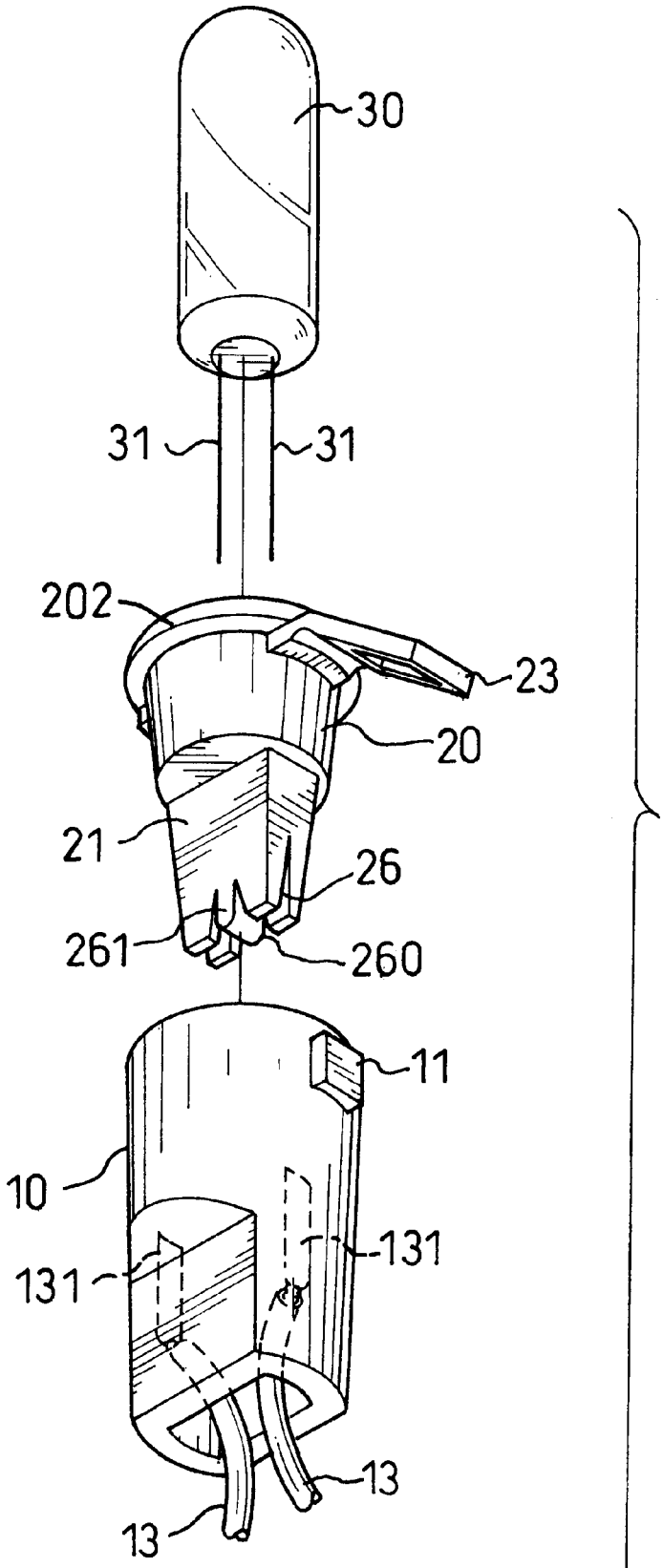
FIG. 6 is a still another preferred embodiment in relationship with this invention.
Figure 7:
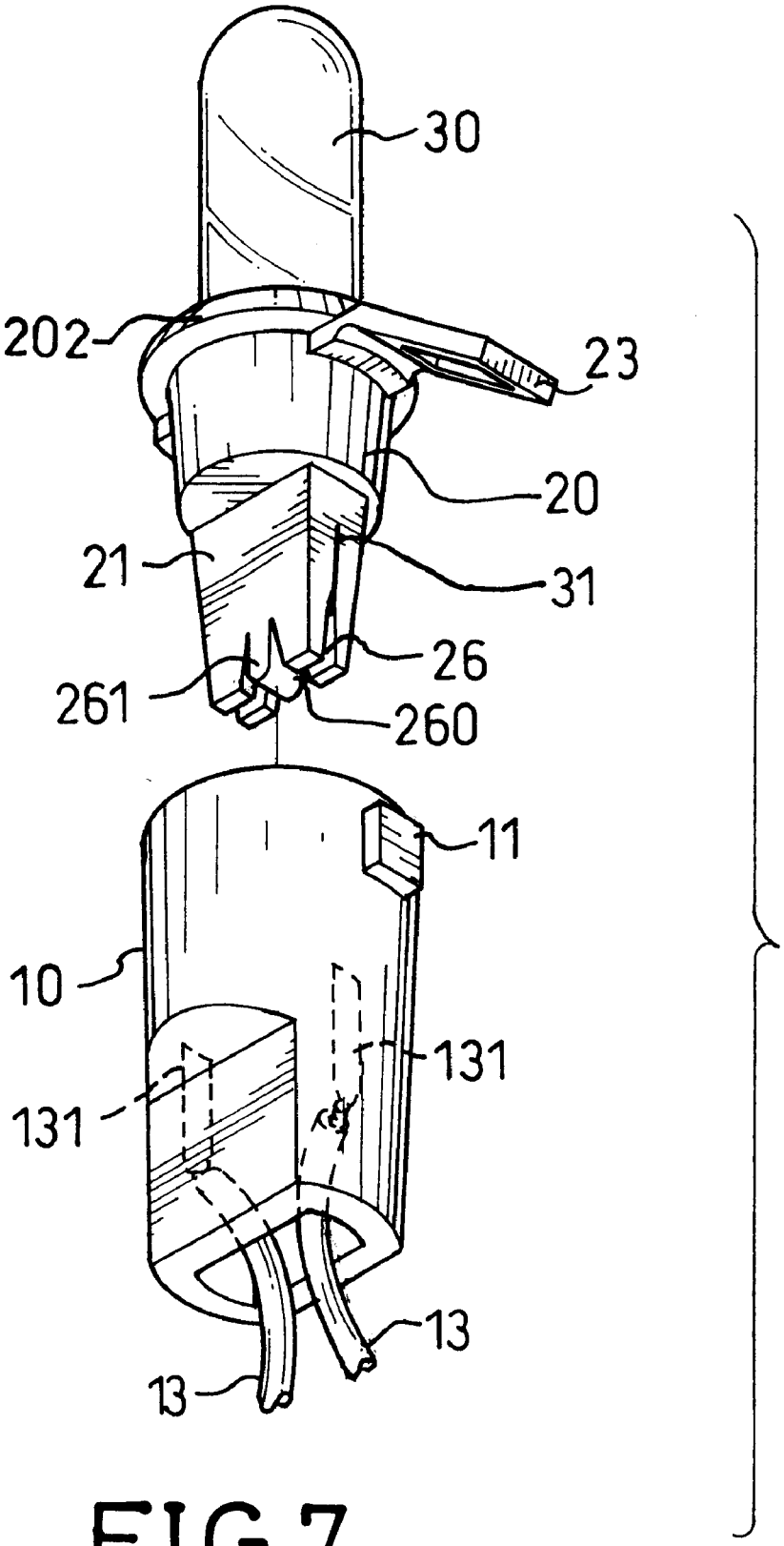
FIG. 7 is a perspective view of the partly assembled embodiment in accordance with FIG. 6.
Figure 8:
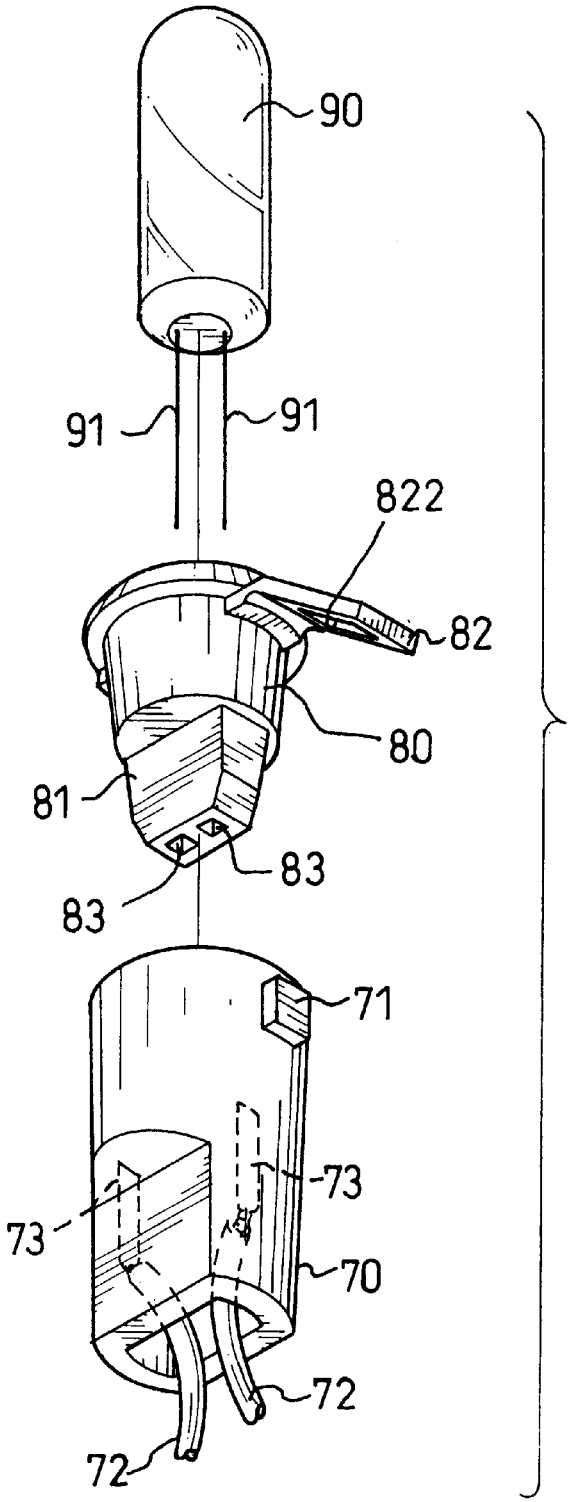
FIG.8 PRIOR ART
FIG. 8 is an exploded perspective view of a conventional combining device of Christmas bulb.
Figure 9:
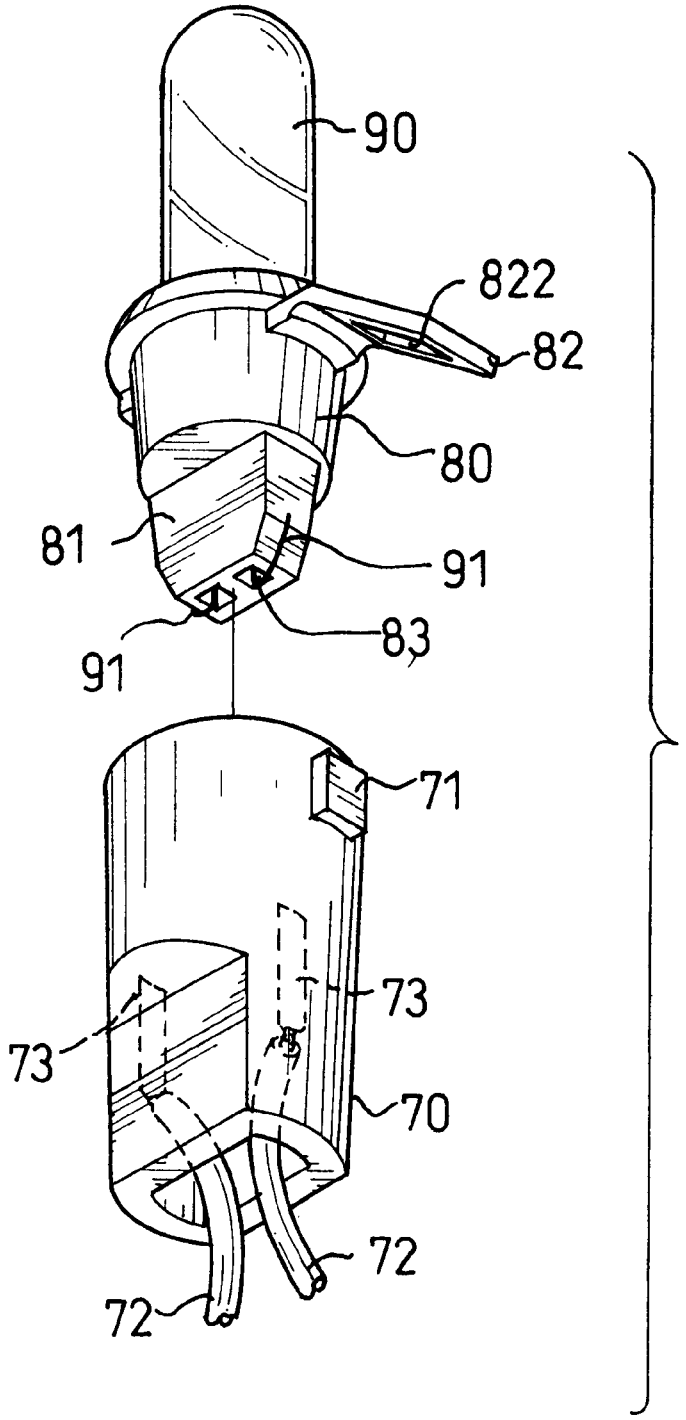
FIG. 9 PRIOR ART
FIG. 9 is a perspective view of the partly assembled conventional combining device of Christmas bulb in accordance with FIG. 8.
Figure 10:
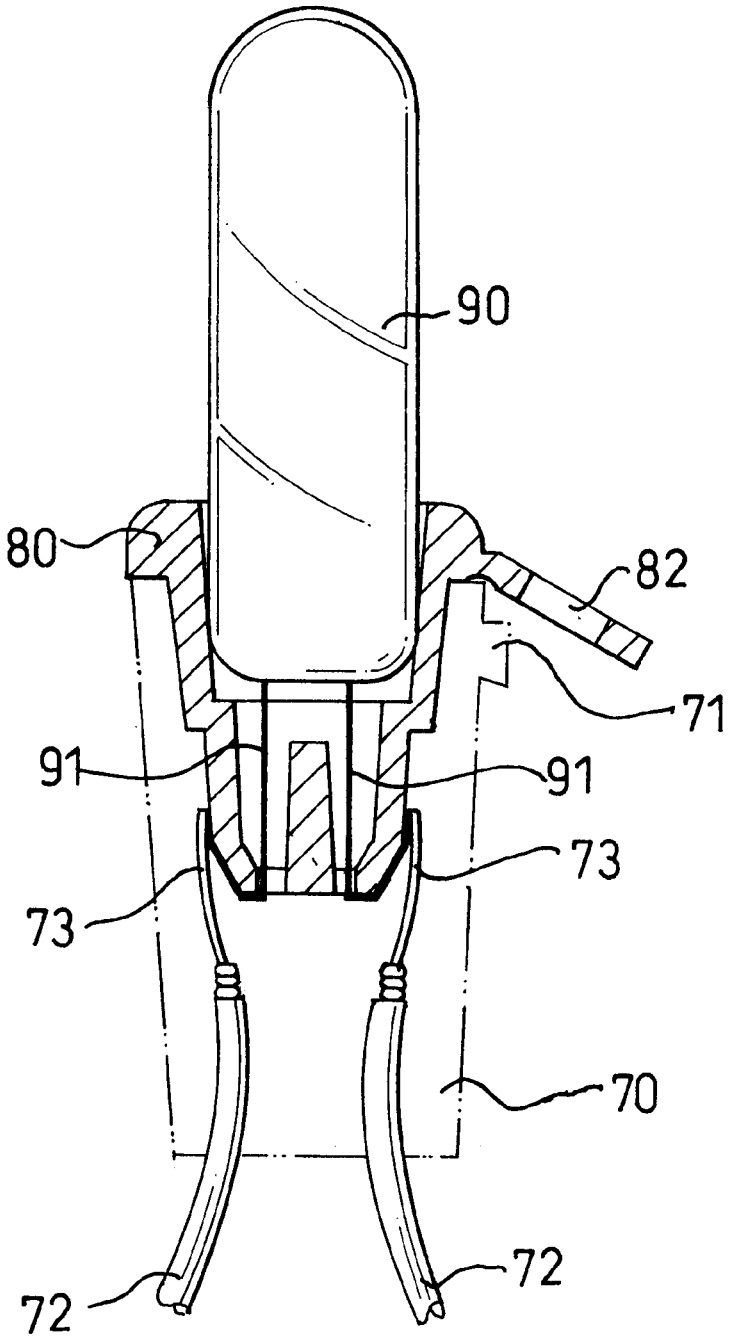
FIG.10 PRIOR ART
FIG. 10 is a cross-sectional side view of the assembled conventional combining device of Christmas bulb in accordance with FIG. 8.

Still another preferred embodiment shown in FIGS. 6 and 7 is still similar to the two aforementioned inventions. The character is that an isolating plate (261) is added vertically to separate the notch (26) into two parts, and each part of the notch (26) has a wire hole (260) defined at the tapered end. Therefore, the inserted wires (13) are isolated by the isolating plate (261) and do not contact with each other to cause a short circuit.

According to above description, it is to be understood that the bulb (30) is securely rested inside the upper portion of the seat (10) and not easy to be loosened because the notch (22, 24, 26) defined in the bottom face of the wedge (21) even that the bulb are in different but size-similar scales. Moreover, the isolating plate (261), as shown in FIGS. 6 and 7, provides even further protection of keeping the wires (13) separated to avoid short circuit.

Details of the structure, functions of the invention and the disclosure are illustrative only and changes may be made in detail, especially in matters of shape, size, and arrangement of parts within the principles of the invention to the full extent indicated by the broad general meaning of the terms in which the appended claims are expressed.

What is claimed is:

1. A Christmas bulb socket comprising:

a hollow bulb seat having a stub formed on a periphery of the bulb seat and two wires inserted inside the seat, said wires each has a conductive plate at a distal end;

a bulb holder having an upper hollow body and a lower wedge, said upper hollow body having a clasp protruding to correspond to the stub of the bulb seat, and said wedge having a lateral inverted V-shaped notch defined in a bottom of the wedge and having two wire holes defined in a tapered end of the notch; and a bulb having two filament feet to go respectively through the wire holes of the bulb holder and into the notch, wherby the filament feet are bent laterally in opposite directions and bent again upward into an opposite side of the lateral notch.

2. The Christmas bulb socket as claimed in claim 1, wherein the notch is cross-shaped.

3. The Christmas bulb socket as claimed in claim 1, wherein the notch having an isolating plate divided the notch into two parts, and each part of the notch has one wire hole defined in a tapered end of the notch.

* * * * *